952/100

United States Patent [19]

Martin et al.

[11] 4,452,643

[45] Jun. 5, 1984

[54] METHOD OF REMOVING COPPER AND COPPER OXIDE FROM A FERROUS METAL SURFACE

[75] Inventors: Larry D. Martin, Al Khobar, Saudi Arabia; Gary W. Bradley, Duncan, Okla.

[73] Assignee: Halliburton Company, Duncan, Okla.

[21] Appl. No.: 457,342

[22] Filed: Jan. 12, 1983

[51] Int. Cl.[3] ..... C23G 1/08

[52] U.S. Cl. ..... 134/3; 134/41; 252/100

[58] Field of Search ..... 134/2, 3, 41; 252/87, 252/100

[56] References Cited

U.S. PATENT DOCUMENTS

| | | | |
|---|---|---|---|
| 1,859,734 | 5/1932 | George . | |
| 2,154,451 | 4/1939 | Hull . | |
| 2,154,455 | 4/1939 | Kepfer . | |
| 2,326,837 | 8/1943 | Coleman | 134/41 X |
| 2,393,866 | 1/1946 | Wassell | 252/100 |
| 2,428,804 | 10/1947 | Terry et al. . | |
| 2,567,835 | 9/1951 | Alquist et al. . | |
| 3,072,502 | 1/1963 | Alfano . | |
| 3,074,825 | 1/1963 | Gardner | 134/41 |
| 3,194,768 | 7/1965 | Lindner et al. | 252/100 X |
| 3,447,965 | 6/1969 | Teumac | 134/41 X |
| 3,496,017 | 2/1970 | Weed | 134/41 X |
| 3,585,142 | 6/1971 | Muzyczko et al. | 134/41 X |
| 3,585,143 | 6/1971 | Muzyczko et al. | 134/41 X |
| 3,664,870 | 5/1972 | Oberhofer et al. | 134/3 |
| 3,803,042 | 4/1974 | Knox et al. | 134/41 X |
| 3,873,362 | 3/1975 | Mihram et al. | 134/41 X |
| 4,051,057 | 9/1977 | Ericson et al. | 252/100 |
| 4,086,176 | 4/1978 | Ericson et al. . | |
| 4,226,640 | 10/1980 | Bertholdt | 134/41 X |

*Primary Examiner*—Marc L. Caroff

*Attorney, Agent, or Firm*—Thomas R. Weaver; Edward F. Sherer

[57] ABSTRACT

A method of removing copper and copper oxide from a ferrous metal surface comprising contacting said metal and said copper oxide with an aqueous composition having a pH from about 3.0 to about 6.0 and comprising an oxidizing agent, a compound selected from the group consisting of oxalic acid, the alkali metal, and ammonium salts of oxalic acid and mixtures thereof, and an ingredient selected from the group consisting of citric acid, polyaminocarboxylic acids, the ammonium and alkali metal salts of citric acid and polyaminocarboxylic acids and mixtures thereof.

18 Claims, No Drawings

METHOD OF REMOVING COPPER AND COPPER OXIDE FROM A FERROUS METAL SURFACE

FIELD OF THE INVENTION

This invention relates to a method of removing copper scale from a ferrous metal surface, and more particularly, but not by way of limitation, to a method of removing copper and copper oxide from a ferrous metal surface whereby copper is not replated on the metal surface.

BACKGROUND OF THE INVENTION

In steam boilers, petrochemical process equipment, feed water heaters, and associated piping, and in various types of pressure vessels in which water is circulated and heat transfer occurs, water insoluble salts deposit on the metallic interior surfaces. The formation or depositation of scale markedly reduces the heat transfer through the walls of such pipes or vessels and furthermore, the capacity of the pipes or vessels and passage of fluids therethrough is restricted by the formation of such scale. Because of the scale formation on the inner surfaces of the pipes, particularly in heat transfer appliances, the pipes are subjected to excessive heat due to the loss of the heat transfer capacity. Further, great pressures are required to overcome the restricting effect of the deposited scale. These disadvantages often lead to leaks and ruptures which necessitate undesirable down time and maintenance costs. Still further, the reduced cross-section of the pipes caused by the formation of the scale can cause an increased pressure drop.

The scale deposit on the vessels usually contains oxides of various metals. Many times vessels are associated with equipment such as condensers, that are constructed of copper alloys, and the scale produced inside the vessel surfaces is frequently found to contain copper scale.

Many different types of methods have been proposed for removing copper scale from a ferrous metal surface. Usually, these involve the use of aqueous acidic solutions containing mineral acids or even organic acids such as citric, acetic, glycolic, or formic.

One method of removing copper scale from a ferrous metal surface involves the use of a strong mineral acid, particularly hydrochloric acid for purposes of dissolving the scale found on the surface of the process equipment, boilers, feed water heaters, and other types of vessels. Although utilization of corrosion inhibitors with mineral acids for cleaning operations has generally prevented acid attack on the equipment surface, such acid treatments have not been universally successful because, when the scale contains copper or copper oxides, many times copper is not dissolved and such copper that is dissolved is redeposited or plated as elemental copper throughout the interior of the vessel surfaces. Such copper depositation serves to accelerate corrosion, particularly in the presence of dissolved ferrous ions, and to interfere with heat exchange reactions.

Another procedure employed for removing copper scale deposits from a ferrous metal surface is to initially contact the surfaces with ammoniacal oxidant wash, such as ammoniacal persulfate, to remove part of the copper deposit followed by contacting the surfaces with a cleaning solution containing an acid plus a copper complexing material. The copper complexing material functions to tie up the copper so that it is dissolved and held in the cleaning solution. Such multistage cleaning procedures however, are expensive to carry out and the copper complexing materials and cleaning solutions which must be used are many times costly. Furthermore, if the deposit containing the copper is thick, long contact times are required to remove the scale which causes additional corrosion of the ferrous metal surfaces.

The present invention provides a method of removing copper deposits from a ferrous metal surface which overcomes or at least mitigates the above-mentioned problems.

SUMMARY OF THE INVENTION

In accordance with the invention, there is provided a method of removing copper and copper oxide from a ferrous metal surface comprising contacting said copper and said copper oxide with an aqueous composition having a pH from about 3.0 to about 6.0 and comprising an oxidizing agent, a compound selected from the group consisting of oxalic acid, the alkali metal, and ammonium salts of oxalic acid and mixtures thereof, and an ingredient selected from the group consisting of citric acid, polyaminocarboxylic acids, the ammonium and alkali metal salts of citric acid and polyaminocarboxylic acids and mixtures thereof.

DETAILED DESCRIPTION OF THE INVENTION

The invention is a method of removing copper and copper oxide from a ferrous metal surface and generally comprises contacting the copper and copper oxide with an aqueous composition having a pH from about 3.0 to about 6.0. The composition comprises an oxidizing agent, a compound selected from the group consisting of oxalic acid, the alkali metal and ammonium salts of oxalic acid and mixtures thereof, and an ingredient selected from the group consisting of citric acid, polyaminocarboxylic acids, and the ammonium and alkali metal salts of citric acid and polyaminocarboxylic acids and mixtures thereof.

Herein and in the claims, unless otherwise specified, the term "ferrous metal surface" means ferrous metal surfaces and metal surfaces in which iron is the major constituent.

Oxidizing agents which are suitable for use in the method of the invention include any oxidizing agent which is stable at a pH of about 3.0 to about 6.0. An example of a suitable oxidizing agent is hydrogen peroxide. The preferred oxidizing agent is an aqueous solution of hydrogen peroxide. When hydrogen peroxide is used in the method of the invention, excellent copper and copper oxide dissolution is achieved. Any excess hydrogen peroxide can be very easily destroyed in situ by catalysis or by heating after its function has been performed.

The amount of oxidizing agent used to carry out the invention will vary, depending upon the metal surface to be cleaned. Generally, the concentration of the oxidizing agent will fall in the range of from about 1 to about 6 percent by weight of the composition. Preferably, 2 percent by weight of the oxidizing agent is employed.

When hydrogen peroxide is utilized as the oxidizing agent, approximately 0.5 weight by weight of composition is generally considered to be the practical lower limit. There is no known high concentration limit, but a solution having a hydrogen peroxide concentration in excess of 20 weight percent is considered hazardous. A 1 percent by weight to about 6 percent by weight of the oxidizing agent can be readily employed in cleaning operations.

A compound selected from the group consisting of oxalic acid, the alkali metal and ammonium salts of oxalic acid and mixtures thereof is utilized in the composition which is used to carry out the method of the invention. The alkali metal and ammonium salts include mono and di substituted salts. The amount of these compounds utilized in the composition will vary over a wide range, and therefore, there are no upper and lower limitations. Generally, the concentration of the compound will fall in the range of from about 1 to about 6 percent by weight of the composition. The preferred concentration of the compound is about 2 percent by weight of the composition. The preferred compound used to carry out the invention is ammonium oxalate.

Furthermore, the composition contains an ingredient selected from the group consisting of citric acid, polyamino-carboxylic acids, the ammonium and alkali metal salts of citric acid and polyaminocarboxylic acid and mixtures thereof. Examples of suitable polyaminocarboxylic acids are widely known and include alkylene diaminetetraacetic acids such as ethylenediamine tetraacetic acid (EDTA), diethylenetriamine pentaacetic acid, N-2-hydroxyethylethylene diamine triacetic acid, propylene-1,2-diamine tetraacetic acid, propylene-1,3 diamine tetraacetic acid, and the isometric butylenediamine tetraacetic acids and the amino triacetic acids such as nitrilo triacetic acid (NTA), as well as the corresponding ammonium and alkali metal salts of these acids. The ingredient preferred for carrying out the method of the invention is ammonium citrate.

The amount of the ingredients useful to carry out the invention will depend on the ferrous metal surface to be cleaned. While increased concentration tends to promote the rate of dissolution in copper and copper oxide, the solubility of the ingredient is somewhat limited. Therefore, the composition will generally contain no more than about 6 weight percent of the ingredient and more preferably a concentration in the range of from about 2 weight percent to about 4 weight percent. Very low concentrations of the ingredient are somewhat effective but the rate of copper and copper oxide dissolution and removal becomes considerably slower and therefore generally commercially impractical for most purposes.

The composition used in the method of this invention is utilized at a pH in the range of from about 3.0 to about 6.0 and more preferably at about 4.5. Adjustment of the pH may be readily accomplished using basic and acidic materials. Basic materials that may be employed are alkali metal oxides or ammonium or alkali metal hydroxides or ammonium hydroxide. Soda lye or sodium hydroxide is conveniently available and may be added in solid form or as a concentrated aqueous solution. Acidic materials employed are well known to those skilled in the art and include mineral acids, such as sulfuric acid and hydrochloric acid, along with organic acids such as formic acid. The precise amount employed to produce the desired pH will of course depend upon the type and amounts of the other ingredients utilized in the composition. Alternatively, the pH may be adjusted by the addition of an acidic or alkaline salt. For example, an alkali metal or ammonium carbonates, phosphates, or borates such as sodium carbonate, ammonium carbonate, bisodium phosphate, trisodium phosphate, sodium pentaborate and the like can be employed. These compounds are sufficiently basic to produce the desired pH and have an added advantage in their ability to sufficiently buffer the resulting composition thereby maintaining the pH in the desired range during the scale removing reaction. A similar result is produced when a buffer compound is added to the composition after the adjustment of the pH. While it is no means necessary to buffer the system to effect copper and copper oxide removal, buffering may be desirable to maintain the pH of the composition in the most effective range particularly where heavy scale deposits exist and consequently long treatment times are contemplated.

The method of the invention is carried out by contacting the ferrous metal surface to be cleaned with the composition by any suitable method, e.g. soaking, pouring, spraying, circulating and the like. During the cleaning, temperatures in the range of about 100° F. to about 150° F. have been found to be most satisfactory, but treatment can be carried out outside this temperature range. Preferably, the treatment is carried out at around 100° F. The time and treatment should be sufficient to remove the copper and copper oxide from the ferrous metal surface, and therefore the time that the composition must contact the surface will depend on the nature and thickness of the deposit and the temperature that the treatment is carried out. In cleaning vessels, heat exchanges, and the like, to insure adequate contact with all surfaces to be cleaned, sufficient composition is introduced into the system to sufficiently fill the system. The composition is then slowly circulated with pumps to contact all surfaces to be cleaned. From time to time additional amounts of the composition can be added to the original quantity placed within the vessel or in contact with a metal so that the capacity of the composition for dissolving the copper and copper oxide can be sufficient to accomplish this objective.

With respect to the pressure which the cleaning process of the invention is carried out, it has been observed that, at times, an advantage is gained by carrying out the method at a pressure slightly in excess of atmospheric pressure. After the composition of the invention has removed the copper and copper oxide formed on the walls of the lines or vessel, the composition is drained from the vessel and the lines or vessels are flushed with water.

The following examples will serve to more comprehensively illustrate the principals of the invention, but in being directed to certain specific compounds and process steps and conditions, are not intended to limit the bounds of the invention.

EXAMPLE I

In order to determine the copper dissolution of the method of the invention, a series of tests were performed. Compositions were prepared by blending various compounds, oxidizing agents and ingredients with water. These compositions were placed in plastic or glass beakers and one copper and one mild steel coupon was added to the beaker. The coupons were prepared as follows:

Copper Coupon Preparation

1. Degrease with acetone.
2. Scrub coupon with steel wool pad and soap until coupon surface is bright and shiny.
3. Rinse with deionized water.

4. Rinse with acetone.
5. Air dry coupon, weigh to nearest 0.001 gram, and record weight as initial weight.

Steel Coupon Preparation

1. Degrease with acetone.
2. Scrub coupon with steel wool pad and soap.
3. Rinse with deionized water.
4. Pickle coupon with dilute HCl for approximately five minutes.
5. Dip coupon in saturated sodium bicarbonate solution to neutralize trace acid.
6. Rinse with deionized water.
7. Rinse with acetone.
8. Air dry, weigh to nearest 0.001 gram, and record weight as initial weight.

The composition containing the copper and steel coupon was placed in a 150° F. water bath for six hours. After the six hour period, the copper coupon was removed from the composition, cleaned, and reweighed. The amount of copper dissolved was thereafter calculated along with the amount of replated copper. The results of these tests are shown in Table I.

TABLE I

| | Cleaning Composition | | | | | |
|---|---|---|---|---|---|---|
| Test | $H_2O_2$ Wt. % | Citric Acid, Wt. % | Oxalic Acid, Wt. % | pH | Copper Wt. Loss grams | Copper Replated grams |
| A. | 0.00 | 2.50 | 2.50 | 4.5 | 0.002 | ND* |
| B. | 2.50 | 0.00 | 2.50 | 4.5 | 0.442 | ND |
| C. | 5.00 | 2.50 | 2.50 | 4.5 | 0.534 | ND |
| D. | 2.50 | 2.50 | 2.50 | 3.0 | 0.572 | ND |
| E. | 2.50 | 2.50 | 0.00 | 4.5 | 0.248 | ND |
| F. | 2.50 | 5.00 | 2.50 | 4.5 | 1.208 | ND |
| G. | 2.50 | 2.50 | 2.50 | 6.0 | 0.742 | ND |
| H. | 2.50 | 2.50 | 5.00 | 4.5 | 0.774 | ND |

*None Detectable, less than 0.001 grams

The test results show that the method of the invention was very effective in removing copper.

EXAMPLE II

In order to determine the copper dissolution of the method of the invention, a series of tests were performed. Compositions were prepared using oxalic acid, citric acid, and hydrogen peroxide. These tests were carried out at a pH of 4.5 and at a temperature of 100° F. for 6 hours. The tests were carried out using the same procedure as described in Example I. The results obtained in these tests are shown in Table II.

TABLE II

| | Cleaning Composition | | | |
|---|---|---|---|---|
| Test | $H_2O_2$ Wt. % | Citric Acid, Wt. % | Oxalic Acid, Wt. % | Copper Wt. Loss grams |
| A. | 2.5 | 2.5 | 2.5 | .585 |
| B. | 2.5 | 2.5 | 5.0 | .573 |
| C. | 2.5 | 5.0 | 2.5 | 1.160 |
| D. | 5.0 | 2.5 | 2.5 | .669 |
| E. | 2.5 | 0.0 | 2.5 | .242 |
| F. | 2.5 | 2.5 | 0.0 | .394 |
| G. | 0.0 | 2.5 | 2.5 | .003 |

The tests results show that the method of the invention was very effective in removing copper.

EXAMPLE III

In order to determine the copper dissolution of the method of the invention along with the amount of iron corrosion of the method, a series of tests using various composition were performed. Compositions were prepared using oxalic acid, EDTA, and hydrogen peroxide. These tests were carried out using the same manner as described in Example I. The pH of the composition was about 4.5. The compositions were placed in a water bath for about six hours. After the six hour period, the copper and steel coupons were removed from the composition, cleaned, and reweighed. The amount of copper dissolved and the amount of iron corrosion was thereafter calculated. The results of these tests are shown in Table III.

TABLE III

| | Cleaning Composition | | | | | |
|---|---|---|---|---|---|---|
| Test | Oxalic Acid Wt. % | EDTA | $H_2O_2$ Wt. % | Temp. | Copper Weight Loss | Iron Weight Loss |
| A. | 2.5 | 2.5 | 2.5 | 100° F. | .001 | .013 |
| B. | 2.5 | 2.5 | 2.5 | 150° F. | .104 | .024 |
| C. | 2.5 | 5.0 | 2.5 | 100° F. | .163 | .046 |
| D. | 5.0 | 2.5 | 2.5 | 100° F. | .700 | .006 |
| E. | 0.0 | 2.5 | 2.5 | 100° F. | .558 | .001 |
| F. | 0.0 | 2.5 | 0.0 | 100° F. | .002 | .049 |
| G. | 2.5 | 2.5 | 0.0 | 100° F. | .004 | .049 |

The results of these tests show that the method of the invention was very effective in removing copper and had minimum iron corrosion.

EXAMPLE IV

Another series of tests were carried out using the method of the invention. Compositions were prepared using NTA, oxalic acid, and hydrogen peroxide. The tests were carried out in the same manner as Example III. The results of these tests are shown in Table IV.

TABLE IV

| | Cleaning Composition | | | | | | |
|---|---|---|---|---|---|---|---|
| Test | Oxalic Acid Wt. % | NTA | $H_2O_2$ Wt. % | Temp. | Copper Weight Loss, Grams | Iron Weight Loss, Grams | Copper Replated Grams |
| A. | 2.5 | 2.5 | 2.5 | 100° F. | .916 | .000 | ND* |
| B. | 2.5 | 2.5 | 2.5 | 150° F. | .912 | .000 | ND |
| C. | 2.5 | 5.0 | 2.5 | 100° F. | .738 | .029 | ND |
| D. | 5.0 | 2.5 | 2.5 | 100° F. | .858 | .000 | ND |
| E. | 0.0 | 2.5 | 0.0 | 100° F. | .003 | .022 | ND |
| F. | 2.5 | 2.5 | 0.0 | 100° F. | .004 | .039 | ND |
| G. | 0.0 | 2.5 | 2.5 | 100° F. | .697 | .001 | ND |

*None Detectable, less than 0.001 grams

The results of these tests show that the method of the invention effectively removed copper with minimum iron corrosion.

While certain embodiments of the invention have been described for illustrative purposes, the invention is not limited thereto. Other modifications or embodiments of the invention will be apparent to those skilled in the art in view of this disclosure. Such modification or embodiments are within the spirit and scope of disclosure.

What is claimed:

1. A method of removing copper and copper oxide from a ferrous metal surface comprising: contacting said copper and copper oxide with an aqueous composition having a pH of from about 3.0 to about 6.0 said composition consisting essentially of:

(a) an oxidizing agent which is stable at a pH of about 3.0 to about 6.0;

(b) a compound selected from the group consisting of oxalic acid, the alkali metal and ammonium salts of oxalic acid and mixtures thereof; and, (c) an ingredient selected from the group consisting of citric acid, polyaminocarboxylic acids, the ammonium and alkali metal salts of citric acid and polyaminocarboxylic acids, and mixtures thereof.

2. The method recited in claim 1 wherein said oxidizing agent is hydrogen peroxide.

3. The method recited in claim 1 wherein said compound is the ammonium salt of oxalic acid.

4. The method recited in claim 1 wherein said ingredient is selected from the group consisting of ethylenediamine tetraacetic acid, diethylenetriamine pentaaceticacid, N-2-hydroxyethylethylene diamine triacetic acid, propylene-1,2-diamine tetraacetic acid, propylene-1,3 diamine tetraacetic acid, nitrilo triacetic acid, the ammonium and alkali metal salts of said acids, and mixtures thereof.

5. The method recited in claim 1 wherein said ingredient is citric acid.

6. The method recited in claim 2 wherein said ingredient is nitrilo triacetic acid.

7. The method recited in claim 1 wherein said composition is contacted with the metal surface at a temperature of about 100° F.

8. The method recited in claim 2 wherein said hydrogen peroxide is present in the range of about 2 percent by weight of the composition.

9. The method recited in claim 1 wherein said pH is about 4.5.

10. A method of cleaning a ferrous metal surface whereby copper and copper oxide is removed from said surface without replating of said copper and said copper oxide on said metal surface comprising: contacting the surface for a sufficient time to remove the copper and copper oxide with an aqueous composition having a pH of about 3.0 to about 6.0 said composition consisting essentially of:

(a) an oxidizing agent which is stable at a pH of about 3.0 to about 6.0;

(b) a compound selected from the group consisting of oxalic acid, the alkali metal and ammonium salts of oxalic acid and mixtures thereof; and, (c) an ingredient selected from the group consisting of citric acid, polyaminocarboxylic acids, the ammonium and alkali metal salts of citric acid and polyaminocarboxylic acids, and mixtures thereof.

11. The method recited in claim 10 wherein said oxidizing agent is hydrogen peroxide.

12. The method recited in claim 10 wherein said compound is the ammonium salt of oxalic acid.

13. The method recited in claim 10 wherein said ingredient is selected from the group consisting of ethylenediamine tetraacetic acid, diethylenetriamine pentaacetic acid, N-2-hydroxyethylethylene diamine triacetic acid, propylene-1,2-diamine tetraacetic acid, propylene-1,3 diamine tetraacetic acid, nitrilotriacetic acid, the ammonium and, alkali metal salts of said acids, and mixtures thereof.

14. The method recited in claim 10 wherein said ingredient is citric acid.

15. The method recited in claim 10 wherein said ingredient is nitrilo triacetic acid.

16. The method recited in claim 10 wherein said composition is contacted with the metal surface at a temperature of about 100° F.

17. The method recited in claim 11 wherein said hydrogen peroxide is present in the range of about 2 percent by weight of the composition.

18. The method recited in claim 10 wherein said pH is about 4.5.

* * * * *